US010207889B2

(12) United States Patent
Yamaguchi

(10) Patent No.: US 10,207,889 B2
(45) Date of Patent: Feb. 19, 2019

(54) IMAGE PROCESSING APPARATUS AND SHEET TRANSPORT METHOD

(71) Applicants: KABUSHIKI KAISHA TOSHIBA, Tokyo (JP); TOSHIBA TEC KABUSHIKI KAISHA, Tokyo (JP)

(72) Inventor: Yoichi Yamaguchi, Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/997,070

(22) Filed: Jun. 4, 2018

(65) Prior Publication Data

US 2018/0282101 A1 Oct. 4, 2018

Related U.S. Application Data

(63) Continuation of application No. 15/279,507, filed on Sep. 29, 2016, now Pat. No. 9,988,234.

(51) Int. Cl.

| | |
|---|---|
| ***B41J 2/32*** | (2006.01) |
| ***B65H 31/24*** | (2006.01) |
| ***B65H 43/02*** | (2006.01) |
| ***B41M 7/00*** | (2006.01) |
| *B41J 2/475* | (2006.01) |

(52) U.S. Cl.

CPC ..... *B65H 31/24* (2013.01); *B41J 2/32* (2013.01); *B41M 7/0009* (2013.01); *B65H 43/02* (2013.01); *B41J 2002/4756* (2013.01); *B65H 2220/01* (2013.01); *B65H 2301/51121* (2013.01); *B65H 2551/20* (2013.01); *B65H 2801/24* (2013.01)

(58) Field of Classification Search

CPC .... B65H 31/24; B65H 2220/01; B65H 29/62; B65H 2301/51121; B41J 2/32; B41J 2/37; B41M 7/0009

See application file for complete search history.

(56) References Cited

U.S. PATENT DOCUMENTS

| | | | | |
|---|---|---|---|---|
| 5,781,822 | A | 7/1998 | Nishiyama et al. | |
| 6,988,728 | B2 | 1/2006 | Kida | |
| 8,422,892 | B2 | 4/2013 | Yoshida et al. | |
| 8,917,300 | B2 | 12/2014 | Arima | |
| 8,941,702 | B2 | 1/2015 | Fukaya | |
| 9,036,201 | B2 | 5/2015 | Hagiwara | |
| 9,908,357 | B2 * | 3/2018 | Yahata | B41M 7/0009 |
| 9,988,234 | B2 * | 6/2018 | Yamaguchi | B41J 2/32 |
| 2013/0016375 | A1 | 1/2013 | Hashidume et al. | |
| 2014/0055545 | A1 | 2/2014 | Fukaya | |
| 2014/0192126 | A1 | 7/2014 | Arima | |

(Continued)

OTHER PUBLICATIONS

Extended European Search Report filed Feb. 26, 2018 in counterpart European Patent Application No. 17192595.1 (7 pages).

*Primary Examiner* — Jeremy R Severson
(74) *Attorney, Agent, or Firm* — Kim & Stewart LLP

(57) ABSTRACT

An image processing system includes an image forming unit, an image decoloring unit, a first sheet stacking unit, a second sheet stacking unit, a first detector for the first sheet stacking unit, a second detector for the second sheet stacking unit, and a control unit. The control unit controls a transport path of a sheet discharged from one of the image forming unit and the image decoloring unit.

16 Claims, 8 Drawing Sheets

(56) References Cited

U.S. PATENT DOCUMENTS

| | | | | |
|---|---|---|---|---|
| 2014/0193169 | A1 | 7/2014 | Shinohara | |
| 2015/0029286 | A1 | 1/2015 | Yagi et al. | |
| 2015/0069694 | A1 | 3/2015 | Taki | |
| 2015/0231893 | A1 | 8/2015 | Yahata | |
| 2016/0368299 | A1 | 12/2016 | Akiyama | |
| 2016/0368300 | A1 | 12/2016 | Yagi et al. | |
| 2018/0024489 | A1* | 1/2018 | Saito | G03G 15/01 399/410 |
| 2018/0208425 | A1* | 7/2018 | Akiyama | B65H 43/04 |

* cited by examiner

IMAGE PROCESSING APPARATUS AND SHEET TRANSPORT METHOD

CROSS-REFERENCE TO RELATED APPLICATION

This application is a continuation of U.S. patent application Ser. No. 15/279,507, filed on Sep. 29, 2016, the entire contents of each of which are incorporated herein by reference.

FIELD

Embodiments described herein relate generally to an image processing system that performs the functions of forming an image on a sheet and decoloring a formed image.

BACKGROUND

An image processing system that performs the functions of forming an image on a sheet and decoloring by heating an image formed by decolorable color material is generally known.

The image processing system heats and pressurizes the image of the decolorable color material and non-decolorable color material transferred on the sheet to fix the image on the sheet prior to discharging the sheet. An image processing system heats the sheet on which the image of the decolorable color material is formed, to a decoloring temperature higher than the fixing temperature to decolor the image prior to discharging the sheet.

The sheets that are discharged include a sheet on which an image is formed using the image forming function, and a sheet on which nothing is printed after decoloring is performed using the decoloring function. If such sheets are discharged on the same tray, the sheet on which the image is formed and the sheet on which the image is decolored are mixed. In such cases, it is necessary to sort the sheets in the discharge tray manually.

DETAILED DESCRIPTION

Figure 1:
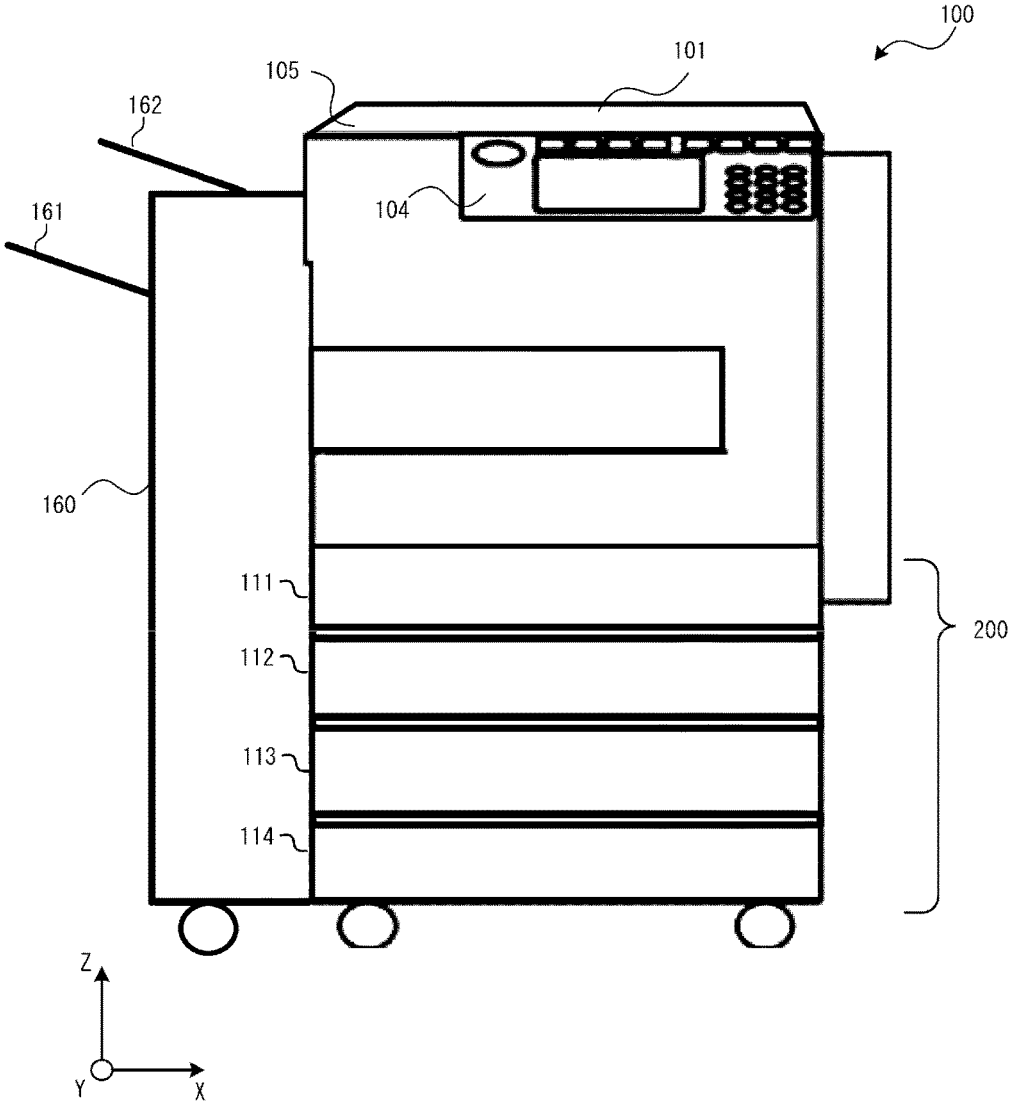
FIG. 1 is an exterior view of an image processing system.

In general, according to one embodiment, an image processing system includes an image forming unit, an image decoloring unit, first and second sheet stacking units, a first sheet detector for the first sheet stacking unit, a second sheet detector for the second sheet stacking unit and a control unit. The control unit is configured to control a transport path of a sheet discharged from one of the image forming unit and the image decoloring unit, so that the sheet is transported to the first stacking unit when: (i) the first sheet detector does not detect a sheet in the first stacking unit, (ii) the second sheet detector detects a sheet in the second stacking unit, and (iii) the sheet in the second stacking unit is a sheet discharged from the other one of the image forming unit and the image decoloring unit, and the sheet is transported to the second stacking unit when: (i) the first sheet detector detects a sheet in the first stacking unit, (ii) the second sheet detector does not detect a sheet in the second stacking unit, and (iii) the sheet in the first stacking unit is a sheet discharged from the other one of the image forming unit and the image decoloring unit.

The image processing system according to the embodiment performs the image forming job for forming the image on the sheet. The image forming job includes each job for forming the image on the sheet such as copying, printing, and FAX reception. An image processing system performs the decoloring job that heats the image on the sheet formed of the decolorable color material to decolor the image, in addition to the image forming job.

The image processing system according to the embodiment includes at least two discharge trays and switches the discharge tray in accordance with a type of job, e.g., decoloring job or image forming job. Thereby, the sheet subjected to image formation and the sheet subjected to decoloring are prevented from being mixed, and it is not necessary to perform the separation work.

The image processing system according to the embodiment may perform both of printing of the decolorable color material and the printing of non-decolorable color material. The decolorable color material is fixed on the sheet at a prescribed fixing temperature or higher, and is decolored if heated at the prescribed decoloring temperature or higher, the prescribed decoloring temperature being equal to or higher than the prescribed fixing temperature. The decolorable color material contains coloring compound, developer, and decoloring agent. The coloring compound, for example, is leuco dye. The developer, for example, is phenols. The decoloring agent includes material compatible with the coloring compound when heated, and which does not have an affinity with the developer. The decolorable color material is colored by interaction between the coloring compound and the developer, and is discolored since the interaction between the coloring compound and the developer is eliminated by the heating at the decoloring temperature or higher.

In addition, although the toner is given as an example of the color material in the embodiments, embodiments are also applicable even when an image forming process employs ink. "Decoloring" as used herein means that the image formed by the color that is different from a base color of the sheet (including an achromatic color such as white and black, as well as a chromatic color) is made to be no longer visible, e.g., by causing the color of the image to be the same or similar color as the base color of the sheet.

Hereinafter, each embodiment will be described with reference to drawings.

Figure 2:
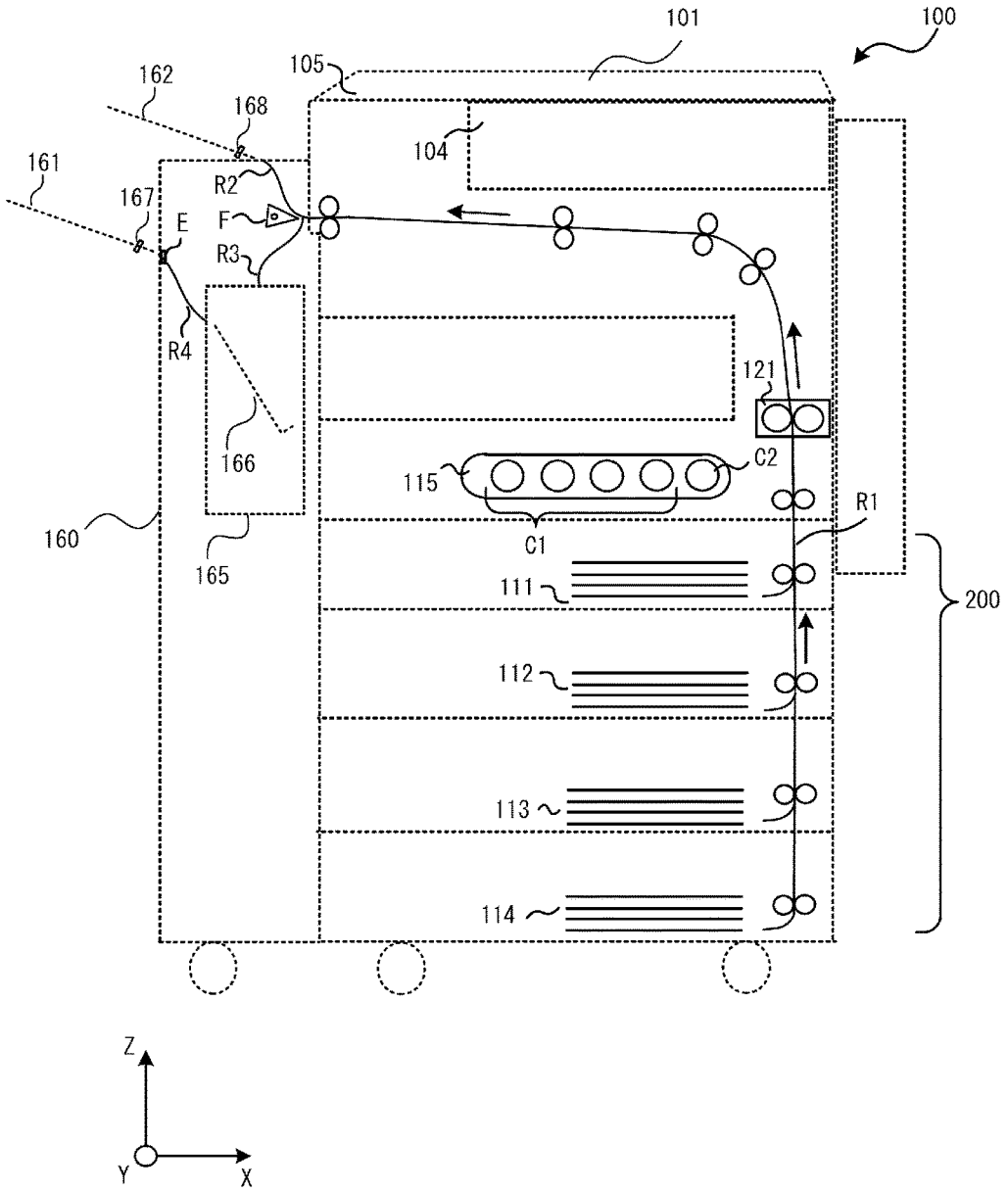
FIG. 2 is a schematic diagram illustrating an inside configuration of the image processing system.

FIG. 1 is an exterior view of an image processing system according to an embodiment. FIG. 2 is a schematic diagram illustrating an inside configuration of the image processing system. In addition, an X-axis, a Y-axis, and a Z-axis in the figure are defined the same way in each drawing. An arrow in FIG. 2 represents a transporting direction of the sheet. Hereinafter, the configuration of the image processing system 100 will be described with reference to FIG. 2.

The image processing system 100 includes an image processing apparatus 101 and a post-processing apparatus 160.

The image processing apparatus 101 includes cassettes 111, 112, 113, and 114 that store and supply sheets when a job is performed. The cassettes 111, 113, and 114 respectively store unused new sheets having different sizes from each other. The cassette 112 stores reusable sheets on which an image formed by decolorable color material has been decolored. The decoloring in the example is carried out by heating at the prescribed decoloring temperature or higher, which is higher than the fixing temperature for the sheet on which the image was formed using the decolorable color material.

Hereinafter, the cassettes 111, 113, and 114 are each referred to as a normal cassette, and the cassette 112 is referred to as a used cassette. The cassettes 111 to 114 represent a paper feeding unit 200 of the image processing system 100.

The image processing apparatus 101 includes an image forming unit 115 that forms the image on the sheet. The image forming unit 115 may perform both the printing with the decolorable color material and the printing with the non-decolorable color material. The image forming unit 115 includes cartridges C1 storing the non-decolorable color material as the normal color material and a cartridge C2 storing the decolorable color material which is decolored at the prescribed decoloring temperature or higher. The cartridges C1 include each color cartridge of cyan, magenta, yellow, and black. The image processing apparatus 101 includes a heater 121 that heats the sheet on which an image is formed while pressure is applied to the sheet to fix the image on the sheet. The heater 121 may generate the heat at the decoloring temperature higher than the fixing temperature. The image processing apparatus 101 may perform the decoloring by heating the sheet supplied from the used cassette 112 at the decoloring temperature.

The image processing apparatus 101 includes a transport path R1 that transports the sheet in the order of the paper feeding unit 200, the image forming unit 115, the heater 121 and the post-processing apparatus 160 (described later). The image processing apparatus 101 includes an operation panel 104 which receives an input of a parameter value, such as the number of printing sets and an instruction of a process start from the user to display a progress status of the job. The image processing apparatus 101 includes a scanning unit 105 that reads a document sheet disposed on a light-transmissive glass plate. The image read by the scanning unit 105 is output to the image forming unit 115, and the image forming unit 115 forms the image on the sheet (copying).

The image processing system 100 includes the post-processing apparatus 160 which may be optionally connected. The post-processing apparatus 160 performs path switching so as to continuously transport the sheet transported via the transport path R1 in any one of a transport path R2 or a transport path R3 by a flapper F. If the sheet is transported to the transport path R2, the sheet is output as is to the discharge tray 162. On the other hand, if the sheet is transported to the transport path R3, the sheet is stacked on a process tray 166 in a post-processing unit 165, and a plurality of sheets are bundled up to be aligned and are subjected to binding, e.g., by stapling and/or center folding. Punching may also be performed on a sheet as a post-processing operation. The sheet bundle after the post-processing operation is output to the discharge tray 161 via a transport path R4. The post-processing unit 165 may include at least any one of a stapler for binding a plurality of sheets, a punching apparatus which punches a hole through each sheet of a bundle to bind a plurality of sheets of the bundle using the holes, and a folding apparatus which folds the sheets of the bundle.

In addition, the discharge tray 161 is a movable tray that moves in a vertical direction (z-axis direction) in accordance with the number of stacked sheets. The discharge tray 161 is located at a lower position as the number of stacked sheets is large, and the discharge tray 161 is located at an upper position as the number of stacked sheets is small. A sensor E disposed at a discharge port of the transport path R4 detects an uppermost surface of the sheet bundle stacked on the discharge tray 161. Thereby, the discharge tray 161 moves in the vertical direction in accordance with the number of stacked sheets.

The discharge tray 161 is located in the lower direction so that the tray may stack the sheet in units of several thousands of sheets. On the other hand, the discharge tray 162 is a non-movable tray and stacks the sheet in units of several hundreds of sheets. Hereinafter, the discharge tray 161 is referred to as the movable tray, and the discharge tray 162 is referred to as a fixed tray. The movable tray 161 includes a first detection sensor 167 that detects whether the sheet is present on the tray or not. The fixed tray 162 includes a second detection sensor 168 that detects the presence or absence of the sheet on the tray.

Figure 3:
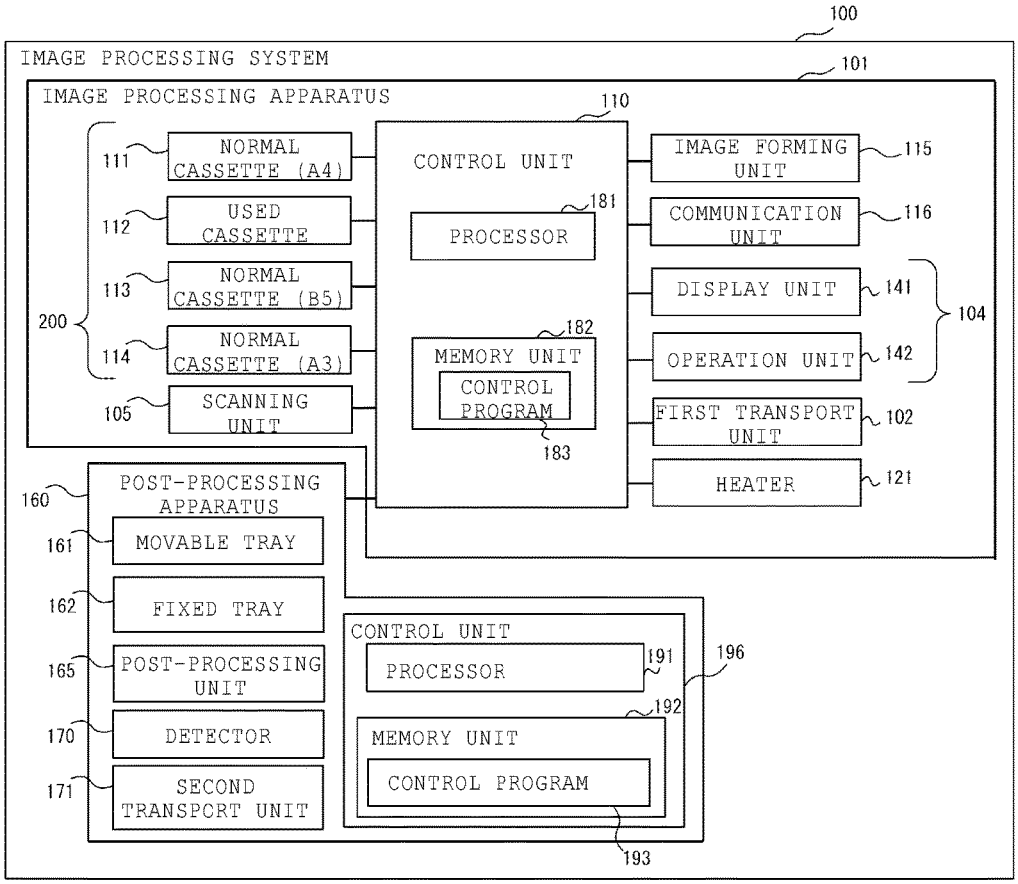
FIG. 3 is a block diagram of components of the image processing system.

FIG. 3 is a block diagram illustrating a configuration example of the image processing system 100 which includes the image processing apparatus 101 and the post-processing apparatus 160.

The image processing apparatus 101 includes a control unit 110 including at least a processor 181 and a storage unit 182.

The processor 181, for example, is an arithmetic processing device such as a central processing unit (CPU). The processor 181 carries out various functions by executing the program stored in the storage unit 182. The storage unit 182 includes a volatile memory, which is the working memory for the processor 181. The storage unit 182 further includes a ROM that stores a control program 183 in a non-volatile manner, and an auxiliary storage device that stores data in a non-volatile manner. The processor 181 executes the control program 183 that is previously stored in the storage unit 182 and loaded into the volatile memory. Thereby, the control unit 110 controls each unit of the image processing apparatus 101. In addition, a portion or all of the functions that the control unit 110 provides may be implemented in a circuit such as an application specific integrated circuit (ASIC).

The image processing apparatus 101 includes a communication unit 116, e.g., a communication card or adapter. The communication unit 116 receives printing data from a personal computer, based on an instruction of the control unit 110. The communication unit 116 transmits a message relating to a process result or status to the personal computer. The image processing apparatus 101 forms an image based on the printing data on a sheet after receiving the printing data.

The operation panel 104 includes a display unit 141, e.g., a liquid crystal monitor of a flat type, and an operation unit 142 that includes a physical button and a touch panel overlaid on the display unit 141. A first transport unit 102 includes the transport path R1, transport rollers or transport belts (not shown), and transports the sheet to each unit in accordance with the instruction of the control unit 110.

For the normal cassettes 111, 113, and 114, and the used cassette 112 illustrated in FIG. 3, a size of the stored sheet is described in parentheses in FIG. 3. In this example, the normal cassette 111 stores the sheet of A4 size. The normal cassette 113 stores the sheet of B5 size, and the normal cassette 114 stores the sheet of A3 size respectively. Although the sheet of prescribed size is stored in the used cassette 112, the size thereof does not matter in the embodiments.

The scanning unit 105, the image forming unit 115, and the heater 121 are as described above.

The movable tray 161, the fixed tray 162, and the post-processing unit 165 in the post-processing apparatus 160 are also as described above. The detector 170 includes first detection sensor 167 and second detection sensor 168, and detects the presence or absence of a sheet stacked on each of the movable tray 161 and the fixed tray 162, respectively. A second transport unit 171 includes the transport paths R2, R3, and R4, transport rollers or transport belts (not shown) and the flapper F, and transports the sheet to each unit or the discharge tray in accordance with the instruction of the control unit 110.

The post-processing apparatus 160 includes the control unit 196 having at least the processor 191 and the storage unit 192. The control program 193 is stored in the storage unit 192. The processor 191 executes the control program 193 that is stored in the storage unit 192. Thereby, the control unit 196, similar to the control unit 110 of the main body of the image processing apparatus 101, controls each unit of the post-processing apparatus 160 (movable tray 161, fixed tray 162, post-processing unit 165, detector 170, and second transport unit 171). The control unit 196 functions in a state where the post-processing apparatus 160 is connected to the image processing apparatus 101. That is, the post-processing apparatus 160 is controlled by the control unit 196 so that each unit of the post-processing apparatus 160 is operated.

Next, switching control of a discharge destination according to the embodiment will be described. Methods described in the flowcharts illustrated in each figure hereinafter are carried out by the processor 181 executing the control program 183.

In the example illustrated in FIG. 4 and in FIG. 6 (described later), the discharge destination of the decoloring job and the discharge destination of the image forming job are previously defined as default destinations. Specifically, when performing the decoloring job, it is previously defined that the sheet after the decoloring is discharged to the movable tray 161 as a default. Conversely, when performing the image forming job, it is previously defined that the sheet after being subjected to the image formation is discharged to the fixed tray 162 as a default.

In many cases, sheets after the decoloring operation are left for a while in its discharge tray even after the process is completed, and are recovered by the user after being accumulated to some extent. On the other hand, because sheets subjected to the image formation are immediately used by the user in many cases, the sheets are in general immediately recovered by the user. Therefore, in FIG. 4 and in FIG. 6 (described later), the image processing system 100 is set up to discharge the sheets after the decoloring to the movable tray 161 capable of stacking more sheets than the fixed tray 162. The image processing system 100 aligns the sheets after the decoloring by the process tray 166 of the post-processing unit 165 and thereafter discharges the sheets to the movable tray 161.

On the other hand, the image processing system 100 is set up to discharge the sheet after being subjected to the image formation to the fixed tray 162 as a default. The fixed tray 162 is disposed at substantially the same position as the operation panel 104 in the height direction, that is, at a position easily accessible to the user. Therefore, the user may easily take the sheet after the process by hand.

In addition, the discharge destination of each job may be reversed.

Figure 4:
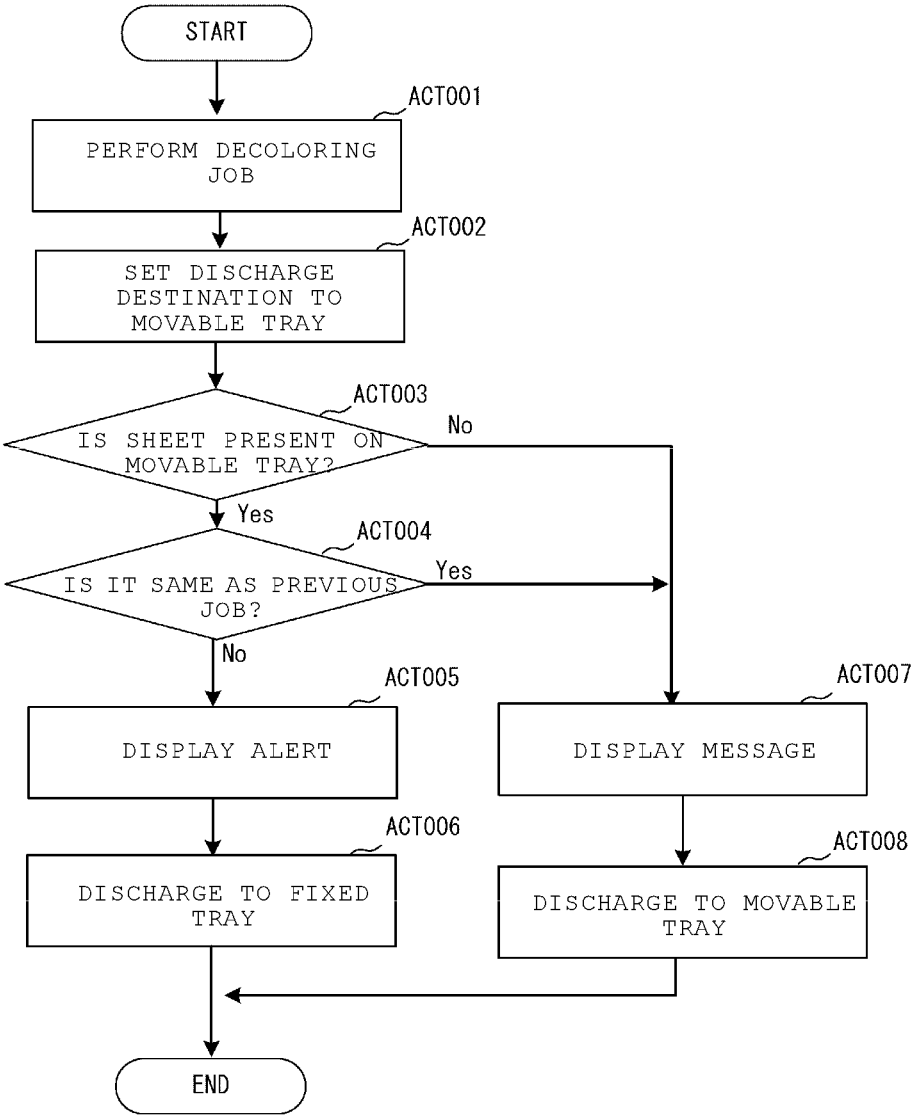
FIG. 4 is a flowchart of a decoloring operation when a discharge tray is defined.

FIG. 4 is a flowchart representing switching control when performing the decoloring job. The processor 181 instructs the performance of the decoloring job to each unit (ACT001), when receiving the performance instruction of the decoloring job via the operation panel 104 from the user, or when it becomes the prescribed time. The processor 181 temporarily sets the discharge destination of the sheet to the movable tray 161 previously defined as a default (ACT002).

Figure 5A:
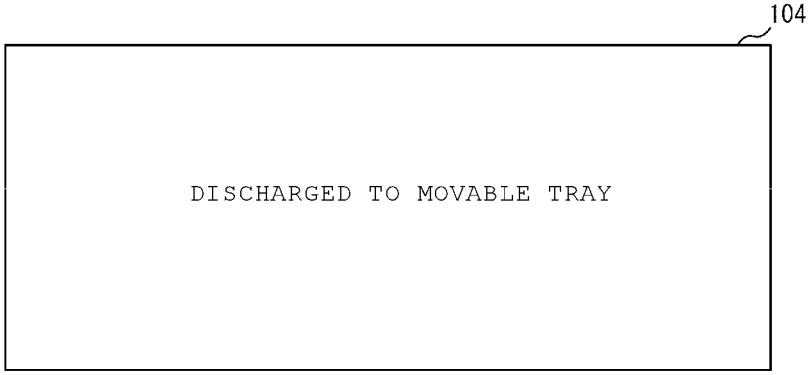
FIGS. 5A and 5B are example messages displayed on a screen of an operation panel.

Here, the processor 181 determines whether the sheet is present on the movable tray 161 (ACT003) in accordance with a detection signal of the first detection sensor 167. When the sheet is absent (ACT003—No), the processor 181 displays a message illustrated in FIG. 5A on the operation panel 104 (ACT007) and causes the sheet to be discharged after the decoloring to the movable tray 161 (ACT008).

When the sheet is present on the movable tray 161 (ACT003—Yes), the processor 181 determines whether a current job (here, decoloring job) is the same type as the previous job, namely the job executed directly before (ACT004).

Figure 5B:
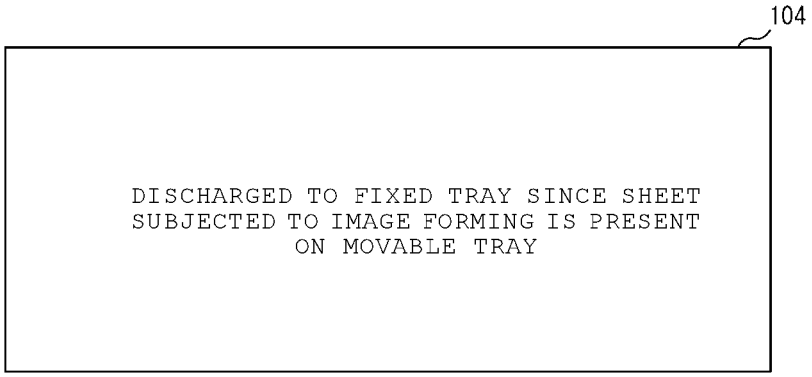

When the current job is the same as the previous job (ACT004—Yes), the process proceeds to ACT007. When the current job is different from the previous job (ACT004—No), the processor 181 displays an alert illustrated in FIG. 5B on the operation panel 104 (ACT005) and causes the sheet to be discharged to the fixed tray 162 (ACT006).

Figure 6:
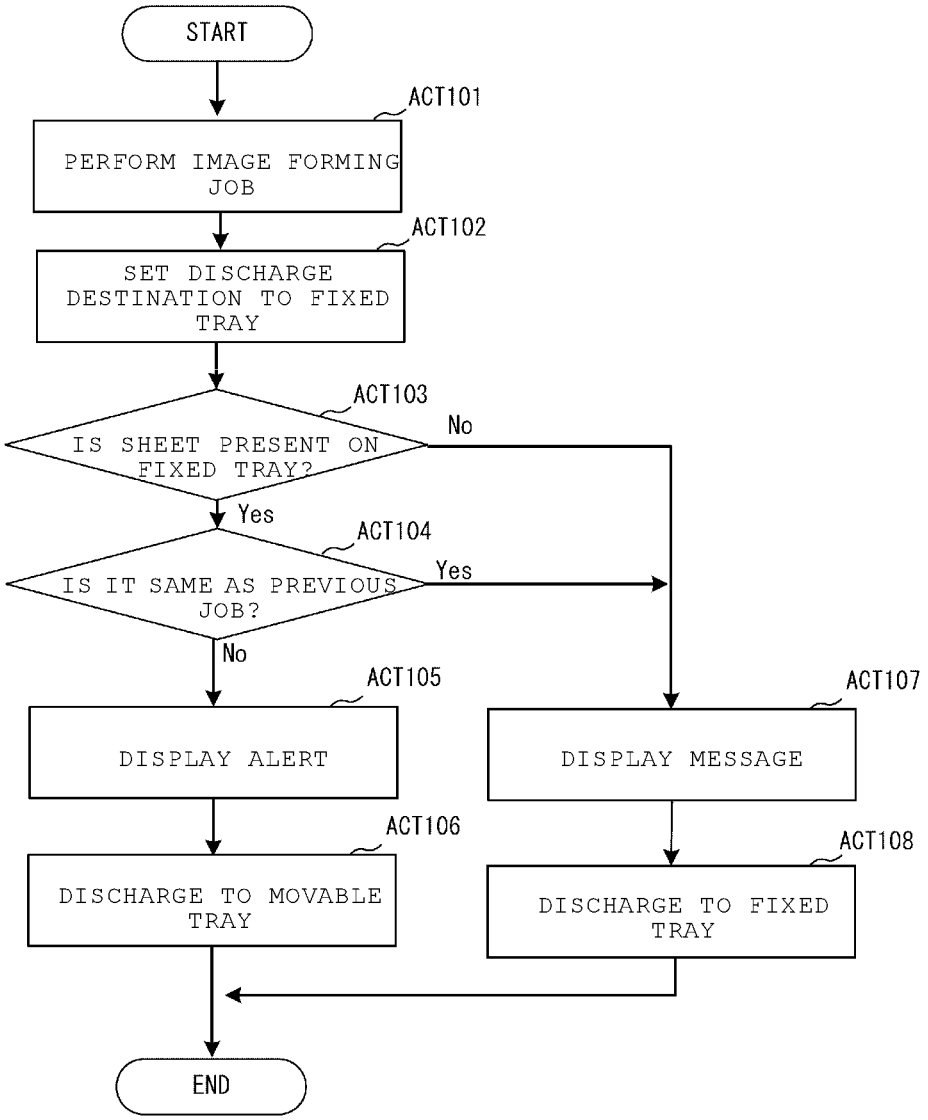
FIG. 6 is a flowchart of an image forming operation when a discharge tray is defined.

FIG. 6 is a flowchart representing the switching control when performing the image forming job. In the example illustrated in FIG. 6, correspondence between a performed job and the discharge destination tray as described above is previously defined, and the correspondence relationship is similar in FIG. 4. The operation illustrated in FIG. 6 is similar to FIG. 4, except that the performed job and the discharge destination tray are different from each other.

The processor 181 starts the performance of the image forming job according to the user's instruction (ACT101). The processor 181 temporarily sets the discharge destination of the sheet to the fixed tray 162 (ACT102).

The processor 181 determines whether the sheet is present on the fixed tray 162, based on the presence or absence of the signal from the second detection sensor 168 (ACT103). When the sheet is absent (ACT103—No), the processor 181 displays the message indicating that the sheet is discharged to the fixed tray 162 (ACT107) and causes the sheet to be discharged after being subjected to the image formation to the fixed tray 162 (ACT108). When the sheet is present on the fixed tray 162 (ACT103—Yes), the processor 181 determines whether a previous job is the image forming job, i.e., the same as the current job (ACT104).

When the previous job is the image forming job (ACT104—Yes), the process proceeds to ACT107. On the other hand, when the previous job is different, that is, when the previous job is the decoloring job (ACT104—No), the processor 181 displays an alert indicating that the sheet is discharged to the movable tray 161 on the operation panel 104 (ACT105) and causes the sheet to be discharged to the movable tray 161 (ACT106).

Hereinbefore, the operation is described in which when the detector 170 detects that the sheet is present in one of the movable tray 161 and the fixed tray 162 (ACT003, ACT103), the control unit 110 (in particular, the processor 181) controls the transport unit 171 to discharge the sheet after the job is performed to the other tray (ACT006, ACT106).

Figure 7:
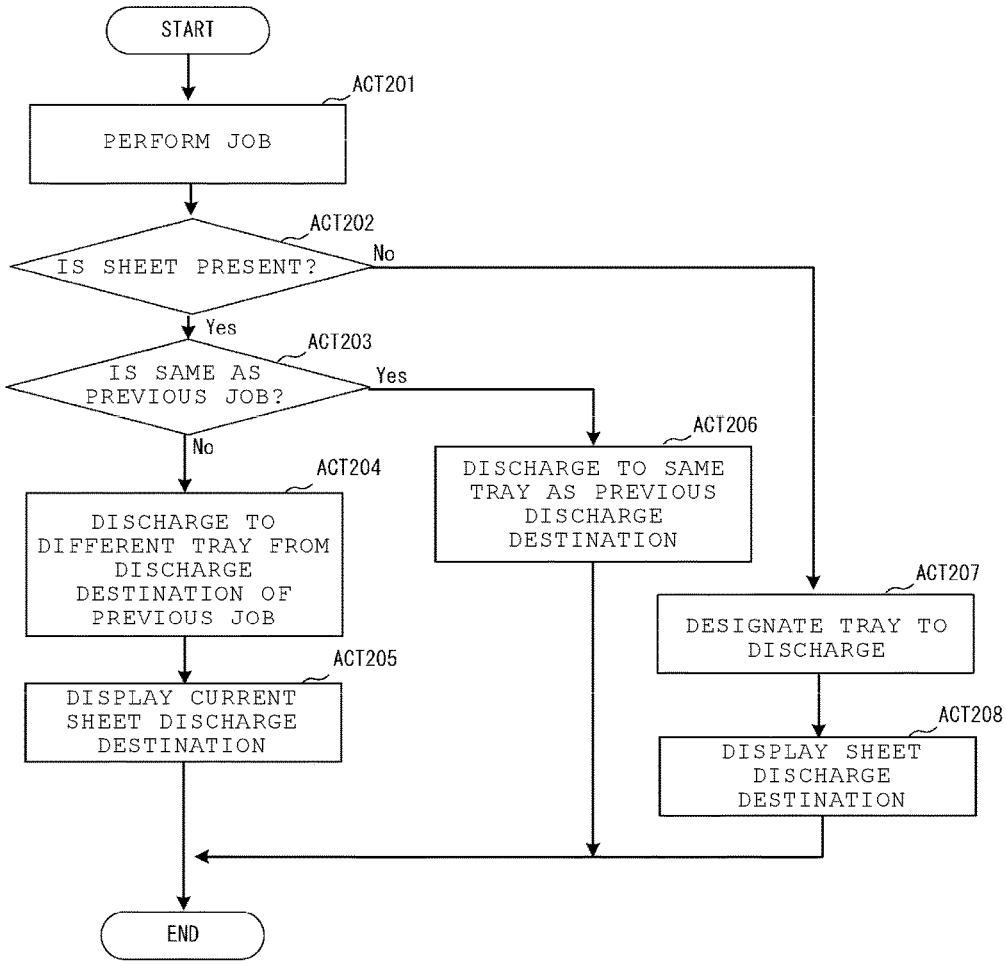
FIG. 7 is a flowchart illustrating an operation example when a discharge tray is not defined.

Although the flowcharts in above FIG. 4 and FIG. 6 illustrate the aspect that the discharge tray is consistently and previously defined in accordance with each job, FIG. 7 illustrates the flowchart of a case the tray is not previously defined.

If the processor 181 receives the performance instruction of any one of the image forming job and the decoloring job (ACT201), the processor determines whether the sheet is present on any one or both of the movable tray 161 and the fixed tray 162 (ACT202). When the sheet is absent on any tray (ACT202—No), the sheet is discharged to the tray designated by the user (ACT207), in accordance with the instruction from the user via the operation panel 104, regardless of the type of the job. The processor 181 displays the tray that is the discharge destination on the operation panel 104 (ACT208).

On the other hand, when ACT202 is a positive determination (ACT202—Yes), the processor 181 determines whether the previous job and the current job are the same (ACT203). When the two jobs are the same (ACT203—Yes), the processor 181 performs control so as to discharge the sheet to the same tray as the previous discharge destination (ACT206).

On the other hand, when the previous job and the current job are different from each other (ACT203—No), the processor 181 performs control so as to discharge the sheet to the tray different from the discharge destination of the previous job (ACT204). The processor 181 displays the current discharge destination of the sheet on the operation panel 104 (ACT205).

Figure 8:
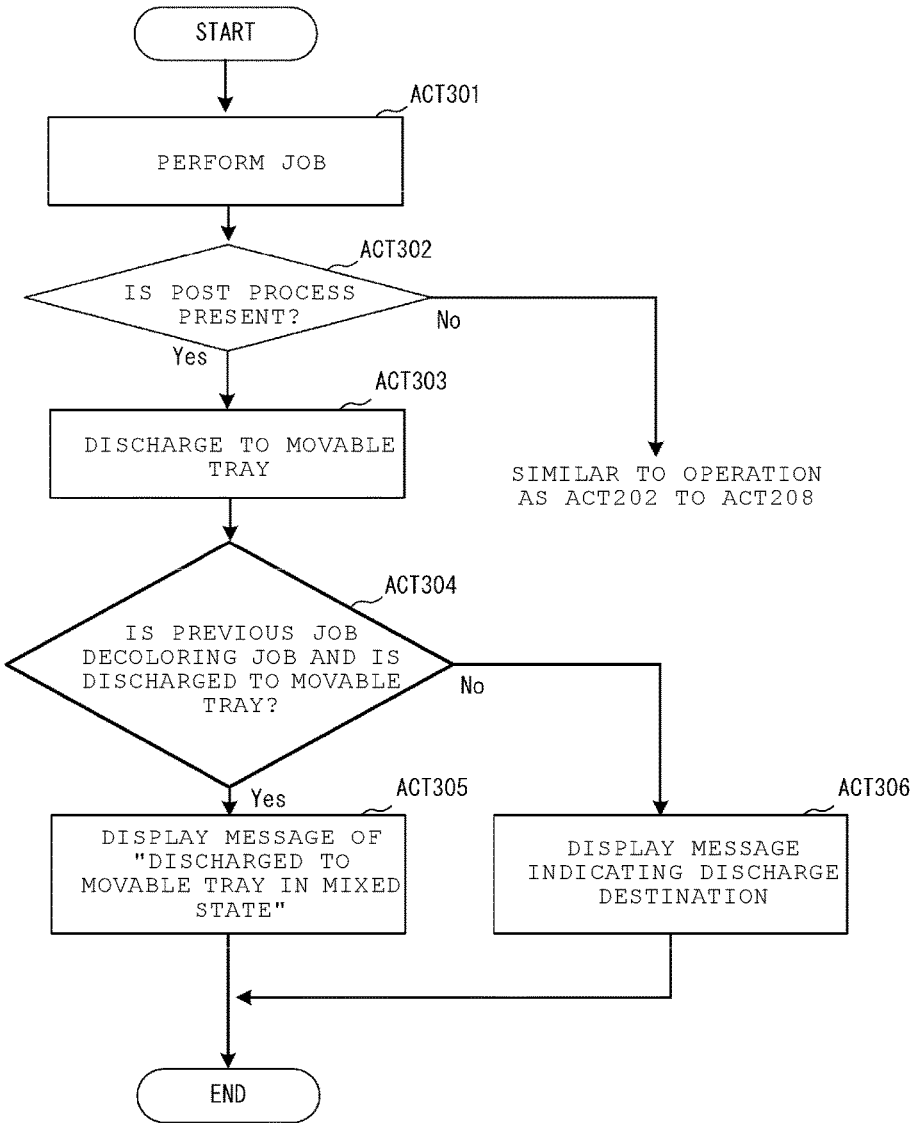
FIG. 8 is a flowchart illustrating an operation example that includes a post-processing operation when a discharge tray is not defined.

FIG. 8 is the flowchart illustrating the operation example in consideration of the image forming job that performs the post-processing operation, to the operation of FIG. 7. When performing the post-processing operation, due to the relationship of the transport path, it is necessary to discharge the sheet to the movable tray 161 after performing the post-processing operation (binding) on the post-processing unit 165 in the example. FIG. 8 is a flowchart in which this fact is taken into account.

Since the decoloring job aims to achieve the reuse of the sheet, it is desirable not to perform the process that damages the sheet such as the folding or the stapling. Accordingly, the post-processing operation (binding) that damages the sheet such as the stapling or the punching, and the folding in the decoloring job should not be performed. Therefore, in the example, the post-processing operation is performed only in the image forming job, and it is assumed that the post-processing operation is not performed in the decoloring job.

If the processor 181 receives the performance instruction of any one of the image forming job and the decoloring job (ACT301), the processor determines whether the instruction is the job with the post-processing operation or not, with reference to a parameters of the job (ACT302). When the instruction is the job without the post-processing operation (ACT302—No), that is, the decoloring job, operations of ACT202 to ACT208 illustrated in FIG. 7 are carried out. When the instruction is the job with the post-processing operation (in this case, the image forming job in the example) (ACT302—Yes), due to the relationship of the transport path, the processor 181 continues the operation so as to discharge the sheet to the movable tray 161 (ACT303). The processor 181 determines whether the previous job is the decoloring job and the sheet is discharged to the movable tray 161 in the previous job (ACT304). That is, in ACT304, the processor 181 determines whether the sheet that is subjected to the decoloring is discharged to the movable tray 161.

When the sheet that is subjected to the decoloring to discharge to the movable tray 161 (ACT304—Yes), for the processor 181, the sheet after being subjected to the image formation by the current image forming job and the sheet after the previous decoloring will be mixed on the movable tray 161. Accordingly, the processor 181 displays the message indicating the mixing of the sheets on the operation panel 104 (ACT305).

When the sheet subjected to the decoloring is not discharged to the movable tray 161 (ACT304—No), the processor displays the message indicating that the sheet is discharged to the movable tray 161 (ACT306), and maintains the operation to discharge the sheet after being subjected to the image formation to the movable tray 161.

In the operation, the operation of each unit configuring the image forming system may be controlled mainly by the control unit 196 of the post-processing apparatus 160. In this case, the above operation is controlled using the processor 191, the storage unit 192, and the control program 193, instead of the control unit 110 of the image processing apparatus 101.

In the above operation, the operation of each unit configuring the image forming system may be controlled by the control unit 110 of the image processing apparatus 101 and the control unit 196 of the post-processing apparatus 160 cooperating with each other. In this case, the control of the operation of each unit that is included in the image processing apparatus 101 is performed by the processor 181, the storage unit 182, and the control program 183 of the control unit 110. The control of the operation of each unit that is included in the post-processing apparatus 160 is performed by the processor 191, the storage unit 192, and the control program 193.

As described above, according to a technology described in the disclosure, it is possible to prevent the sheet after being subjected to the image formation and the sheet after the decoloring from being mixed on the same tray.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An image processing system comprising:

an image forming unit;

an image decoloring unit;

first and second sheet stacking units, one of the first and second sheet stacking units being a movable tray that moves in a vertical direction;

a first sheet detector for the first sheet stacking unit, the first sheet detector being disposed in the movable tray;

a second sheet detector for the second sheet stacking unit; and a control unit configured to control a transport path of a sheet discharged from one of the image forming unit and the image decoloring unit, so that the sheet is transported to the first stacking unit when: (i) the first sheet detector does not detect a sheet in the first stacking unit, (ii) the second sheet detector detects a sheet in the second stacking unit, and (iii) the sheet in the second stacking unit is a sheet discharged from the other one of the image forming unit and the image decoloring unit, the sheet is transported to the second stacking unit when: (i) the first sheet detector detects a sheet in the first stacking unit, (ii) the second sheet detector does not detect a sheet in the second stacking unit, and (iii) the sheet in the first stacking unit is a sheet discharged from the other one of the image forming unit and the image decoloring unit, the sheet is transported to the moveable tray when: (i) the first sheet detector detects that the sheet is present on the movable tray, (ii) the previous job is a decoloring job, and (iii) the decoloring job is performed, and the sheet is transported to a non-moveable sheet stacking unit when: (i) the first sheet detector detects that the sheet is present on the movable tray, (ii) the previous job is an image forming job, and (iii) the image forming job is performed.

2. The system according to claim 1, wherein the control unit is configured to determine whether or not the sheet detected in the first or second stacking unit is a sheet discharged from the other one of the image forming unit and the image decoloring unit by comparing a current job with a previous job.

3. The system according to claim 2, further comprising:

a display unit, wherein the control unit is further configured to control the display unit to display a message that indicates the sheet stacking unit to which the sheet is transported.

4. The system according to claim 1, further comprising:

a post-processing unit configured to perform a post-processing operation, wherein the image forming job includes any job that performs the post-processing operation in addition to an image forming job that does not perform the post-processing operation.

5. The system according to claim 4, wherein when a discharge destination after the post-processing operation is the sheet stacking unit where the sheet of a decoloring job is discharged, the control unit is configured to control the display unit to display a message.

6. The system according to claim 1, further comprising:

a display unit, wherein when discharging the sheet after the decoloring process to the non-movable sheet stacking unit, the control unit is configured to control the display unit to display a message that indicates the sheet stacking unit to which the sheet is transported.

7. The system according to claim 1, wherein the control unit is configured to control the transport unit to discharge the sheet after the decoloring process to the sheet stacking unit designated by a user when no sheets are on either of the first sheet stacking unit and the second sheet stacking unit.

8. The system according to claim 7, further comprising:

a display unit, wherein the control unit is configured to control the display unit to display a message that indicates the sheet stacking unit to which the sheet is transported.

9. A sheet transport method comprising:

detecting, with a first sheet detector, a presence or absence of a sheet on a first sheet stacking unit;

detecting, with a second sheet detector, a presence or absence of a sheet on a second sheet stacking unit, one of the first and second sheet stacking units being a movable tray that moves in a vertical direction, the first sheet detector being disposed in the movable tray; and controlling a transport path of a sheet discharged from one of an image forming unit and an image decoloring unit, so that the sheet is transported to the first stacking unit when: (i) the first sheet detector does not detect a sheet in the first stacking unit, (ii) the second sheet detector detects a sheet in the second stacking unit, and (iii) the sheet in the second stacking unit is a sheet discharged from the other one of the image forming unit and the image decoloring unit, the sheet is transported to the second stacking unit when: (i) the first sheet detector detects a sheet in the first stacking unit, (ii) the second sheet detector does not detect a sheet in the second stacking unit, and (iii) the sheet in the first stacking unit is a sheet discharged from the other one of the image forming unit and the image decoloring unit, the sheet is transported to the moveable tray when: (i) the first sheet detector detects that the sheet is present on the movable tray, (ii) the previous job is a decoloring job, and (iii) the decoloring job is performed, and the sheet is transported to a non-moveable sheet stacking unit when: (i) the first sheet detector detects that the sheet is present on the movable tray, (ii) the previous job is an image forming job, and (iii) the image forming job is performed.

10. The method according to claim 9, further comprising:

determining whether or not the sheet detected in the first or second stacking unit is a sheet discharged from other one of the image forming unit and the image decoloring unit by comparing a current job with a previous job.

11. The method according to claim 10, further comprising:

controlling a display unit to display a message that indicates the sheet stacking unit to which the sheet is transported.

12. The method according to claim 9, wherein the image forming job includes any job that performs a post-processing operation in addition to an image forming job that does not perform the post-processing operation.

13. The method according to claim 12, further comprising:

when a discharge destination after the post-processing operation is the sheet stacking unit where the sheet of decoloring job is discharged, displaying a message.

14. The method according to claim 9, further comprising:

when discharging the sheet after the decoloring process to the non-movable sheet stacking unit, displaying a message that indicates the sheet stacking unit to which the sheet is transported.

15. The method according to claim 9, wherein the sheet after the decoloring process is discharged to the sheet stacking unit designated by a user when no sheets are on either of the first sheet stacking unit and the second sheet stacking unit.

16. The method according to claim 15, further comprising:

displaying a message that indicates the sheet stacking unit to which the sheet is transported.

* * * * *